US006434908B1

(12) United States Patent
Ferrante

(10) Patent No.: US 6,434,908 B1
(45) Date of Patent: Aug. 20, 2002

(54) METHOD OF CAPS FABRICATING RIGID SECTION BARS TO BE ARTICULATED MANUALLY

(76) Inventor: Massimo Ferrante, Via Jovane, 174 - 84014, Nocera Inferiore (SA) (IT)

( * ) Notice: Subject to any disclaimer, the term of this patent is extended or adjusted under 35 U.S.C. 154(b) by 0 days.

(21) Appl. No.: 09/355,281

(22) PCT Filed: Jan. 26, 1998

(86) PCT No.: PCT/IT98/00010

§ 371 (c)(1),
(2), (4) Date: Jul. 28, 1999

(87) PCT Pub. No.: WO98/32931

PCT Pub. Date: Jul. 30, 1998

(30) Foreign Application Priority Data

Jan. 29, 1997 (IT) ..... RM97A0039

(51) Int. Cl.[7] ..... E04C 3/07

(52) U.S. Cl. ..... 52/731.7; 52/730.6; 52/733.1; 52/658; 52/669

(58) Field of Search ..... 52/731.7, 730.6, 52/733.1, 745.19, 506.06, 506.07, 506.08, 634, 635, 667, 669, 658, 720.1; 428/603

(56) References Cited

U.S. PATENT DOCUMENTS

| | | | | | |
|---|---|---|---|---|---|
| 2,483,560 | A | * | 10/1949 | Peterson | 52/645 |
| 3,890,755 | A | * | 6/1975 | Specht | 52/645 |
| 4,308,706 | A | * | 1/1982 | Rijnders | 52/738 |
| 4,364,215 | A | * | 12/1982 | Gailey et al. | 52/667 X |
| 4,426,822 | A | * | 1/1984 | Gailey | 52/669 |
| 4,713,919 | A | * | 12/1987 | Platt | 52/729.3 |
| 4,783,946 | A | * | 11/1988 | Boegle | 52/669 X |
| 4,785,595 | A | * | 11/1988 | Dunn | 52/232 |
| 4,881,355 | A | * | 11/1989 | Bosl et al. | 52/738 |
| 5,390,453 | A | * | 2/1995 | Untiedt | 52/90 |
| 5,433,051 | A | * | 7/1995 | Johansson | 52/367 |
| 5,527,625 | A | * | 6/1996 | Bodnar | 428/595 |
| 5,761,869 | A | * | 6/1998 | Tinen et al. | 52/506.07 |

FOREIGN PATENT DOCUMENTS

| | | | |
|---|---|---|---|
| DE | 296 19 739 | * | 1/1997 |
| IT | 1246940 | * | 11/1994 |

* cited by examiner

*Primary Examiner*—Lanna Mai
*Assistant Examiner*—Winnie Yip
(74) *Attorney, Agent, or Firm*—Browdy and Neimark, P.L.L.C.

(57) ABSTRACT

The present invention relates to a method of fabricating rigid section bars able to be articulated manually, comprising a first phase wherein, on a band of suitable material, a succession of areas of weakening transverse with respect to the longitudinal axis of said band is obtained by shearing, said areas including polygonal slots whose axis of symmetry is transverse with respect to said longitudinal axis, alternatively upset with respect thereto, and further including lighteners obtained on transverse straight lines passing through vertices, chamfered with relatively wide fillets, of said polygonal slots; and a second phase wherein said band is formed according to an open profile terminating, at its ends, with free edges. The invention further relates to the section bars obtained thereby.

8 Claims, 3 Drawing Sheets

METHOD OF CAPS FABRICATING RIGID SECTION BARS TO BE ARTICULATED MANUALLY

CROSS REFERENCE TO RELATED APPLICATION

The present application is the national stage under 35 U.S.C. 371 of PCT/IT98/00010, filed Jan. 26, 1998.

BACKGROUND OF THE INVENTION

1. Technical Field of the Invention

The present invention relates to a method of fabricating section bars, able to be articulated manually, usable as frames for walls, false walls, false ceilings and other architectural elements, and to the section bars obtained thereby.

2. Prior Art

Italian patent IT-A-1246940 describes a load-bearing section bar able to be articulated, usable as a contour and support to light structures, comprising a succession of open box elements. Each box element, obtained starting from a sheet metal band, is joined to the subsequent one by means of weakening areas obtained by drilling holes aligned transversely and by bending onto themselves band edges adjacent to said holes. In the band folds thus fabricated, opposed hinges are obtained whose axis is orthogonal with respect to the core of the section bar. Such hinges are normally known as plastic hinges, i.e. artefact areas wherein strong plastic deformations concentrate and wherein local deformation is allowed to grow without a corresponding increase in the bending moment.

Thus, the presence of these plastic hinges, though on one hand makes the section bar able to be articulated, on the other hand reduces its rigidity, so that, in order to be handled and transported, the section bar requires suitable stiffening elements.

In the second place, in order to have the required bending capability and meet installation requirements, it is necessary to increase the number of hinges per unit of section bar length, thereby increasing material wastage accordingly. The quantity of band required to manufacture a section bar capable of being articulated according to Italian patent IT-A-1246940 is inversely proportional to the size of the minimum bending radius allowed by the section bar.

From the point of view of construction such plastic hinges, as is evident, cause increased costs because, in addition to the intrinsic material wastage, they require a prolonged work process, particularly for that phase of longitudinal compression of the band in a state wherein it is already bent into a C shape. This phase also requires suitable tooling. The usage of the aforementioned section bar also entails some drawbacks, some of which are identified in the discussion that follows. Since the prior art section bar has multiple degrees of freedom for each hinged sector, the installer is forced preventively to stiffen it by screwing thereon a template or other tool that maintains it in the desired shape at least until the application of the covering plate that determines the structural collaboration between the support element, i.e. the section bar, and the borne element, i.e. a plate or the like, by means of fastening screws.

Indeed, because of its remarkable ability to be articulated, the prior art section bar can be used solely for curved parts.

Moreover, at the building site the section bar must necessarily be handled with its rigid packaging materials and thus with increased weight.

Additionally, the retrieval of building site residue forces the installer to reinsert the section bars not used in the construction process into the rigid packaging, with the deriving increase in the time needed to clear the site out and hence in costs for the construction firms.

Also, the presence of frequent empty areas constituted by the compacted hinges, makes very likely the possibility of screwing the fastening screws of the panels in such large and opposite areas, causing time wastage for the installer forced, in that case, to remove the screw placed in an empty area and to screw it again in a position where it meets the rigidity of the section bar.

Additionally, the presence of a great number of hinges taking up the inner space of the section bar makes it awkward to move the uprights. In addition to the section bar described above, there are other U-shaped section bars lacking plastic hinges, but provided with broad rectangular notches, obtained in the core and, in part in the wings of the section bar, or in the core and in one wing in order to render the section bar capable of being articulated. However this type gives no guarantee of suitable response, when installed, to the stresses deriving from its combination with the structural elements. Furthermore, DE-U-29619739 discloses a band of suitable plane material, in which a succession of weakening areas transverse with respect to the longitudinal axis of said band is obtained by shearing, but the deformation of its articulation section is difficult and requires hard manual efforts.

OBJECT AND SUMMARY OF THE INVENTION

The object of the present invention therefore is to eliminate the drawbacks mentioned above of the section bars usable as frames for walls, false walls, false ceilings and other architectural elements, providing a method of fabricating a section bar that is rigid but able to be articulated manually at the moment of installation without having to use additional tooling.

In particular another object of the invention is to provide a method of fabricating a section bar as mentioned above which requires a reduced number of phases and without material wastage per unit of linear length.

Yet another object is to provide such a method of fabrication as to be applicable to all the shapes of section bars destined to be used in light prefabrication, in particular also to those section bars which, for the sake of working safety, present turned-back free edges or folded back edges due to functional requirements of hitching, fastening or the like. In its first aspect the invention, as it is characterised by the claims that follow, solves the problem of providing a method of fabricating rigid section bars able to be articulated manually, usable as frames for walls, false walls, false ceiling or other architectural elements section bars of the metal band type or made of other suitable plane material, formed with an open profile, fitted with a base or core and shaped as a C, a U, an Ω or the like and provided at regular longlitudinal intervals with an articulation section, which from a general point of view, is characterised in that it comprises:

a first phase wherein, on a band of suitable material, a succession of areas of weakening transverse with respect to the longitudinal axis of said band is obtained by shearing, such weakening areas including polygonal slots whose axis of symmetry is transverse with respect to said longitudinal axis, alternatively upset with respect thereto, and further including lighteners obtained on transverse straight lines passing through vertices, chamfered with relatively wide fillets, of said polygonal slots; and a second phase wherein said band is formed according to an open profile terminating, at its ends, with free edges.

In its second aspect the invention, as it is characterised by the claims that follows, solves the problem of providing a rigid section bar able to be articulated manually, usable as a frame for walls, false walls, false ceilings or other architectural elements, section bars of the type made with a metal band or other suitable plane material formed with an open profile, fitted with base or core and shaped in a C, a U, an Ω or the like and provided at regular longitudinal intervals with an articulation section, which from the general point of view is characterised in that it comprises a band of suitable material, provided with a succession of areas of weakening transverse with respect to the longitudinal axis of said band, including polygonal slots whose axis of symmetry is transverse with respect to said longitudinal axis alternatively upset with respect thereto, and further provided with lighteners obtained on transverse straight lines passing through vertices, chamfered with relatively wide fillets, of said polygonal slots; said band, fitted with said slots and lighteners, being shaped according to an open profile terminating, at its ends, with free edges.

The advantages obtained through the present invention consist essential of:

making the performance of the profile, in essence the size of the minimum radius of curvature obtainable, independent from the quantity of material necessary to produce the section bar, unlike the section bar of the prior art patent mentioned above where the number of hinges provided per unit of length of the section bar, inversely proportional to the possible radius of curvature, conditions the weight of the section bar per unit of length;

allowing the production of a rigid section bar able to be articulated and thus to be shaped longitudinally on the building site or upon installation, easily and without requiring stiffening interventions;

minimizing the weight of the section bar to be transported and to be handled on the building site and the time required to retrieve building site residues;

making fabrication easier, with a reduced number of phases, and with the possibility of using the same tooling required for the fabrication of current section bars;

obtaining a section bar usable both for rectilinear and for curved lengths;

obtaining a section bar that, upon installation, reduces the frequency of invalid screw-ins in the connection with other constructive elements, such as plates or panels;

obtaining a section bar wherein the dimensions in its inner space are minimised, in order to ease the movement of the uprights.

BRIEF DESCRIPTION OF THE DRAWINGS

Additional characteristics and advantages of the present invention will be made clearer in the detailed description that follows, of preferred embodiments and variations shown purely by way of non limiting indication in the attached drawings wherein.

DETAILED DESCRIPTION OF THE PREFERRED EMBODIMENT(S) OF THE INVENTION

Figure 1:
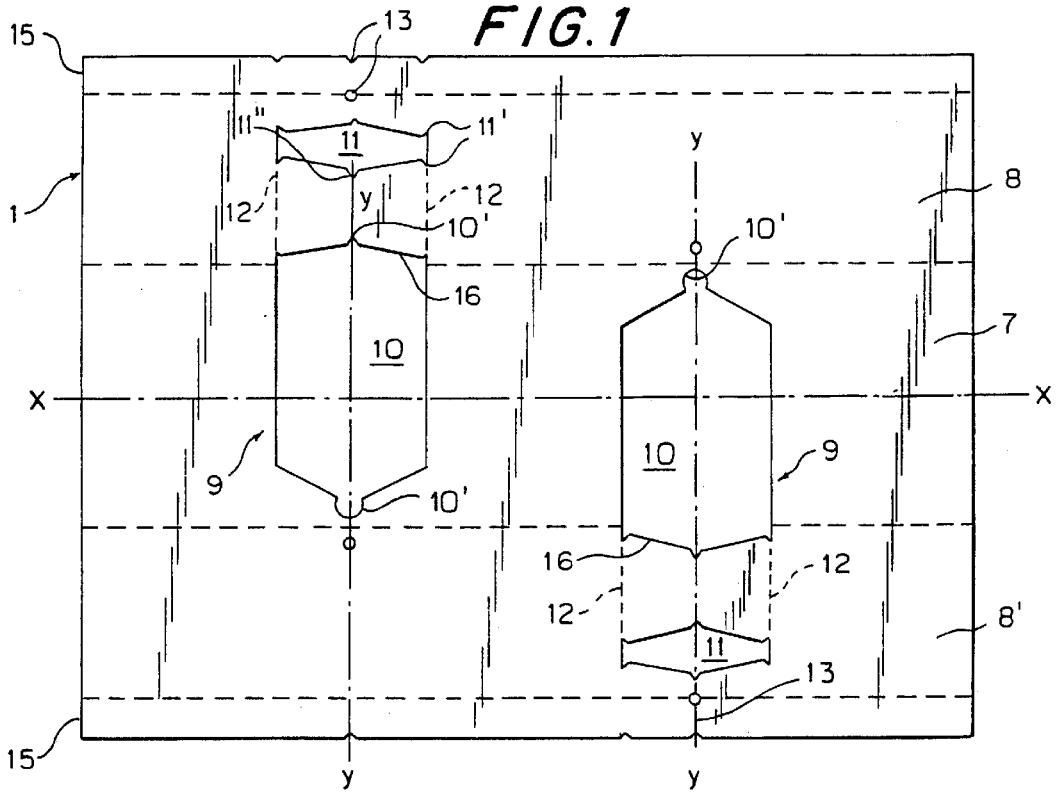
FIG. 1 shows in plan view a portion extending in a plane of a first embodiment of a section bar able to be articulated according to the present invention.

The method of fabricating rigid section bars able to be articulated manually is performed starting preferably from a metal band but also from a suitable plane plastic material. On the band is obtained, by shearing, a succession of weakening areas transverse with respect to the longitudinal axis of said band. Each weakening area includes polygonal slots whose axis of symmetry is transverse with respect to said longitudinal axis, alternatively upset with respect thereto, and further including lighteners obtained on transverse straight lines passing through vertices, chamfered with relatively wide fillets, of said polygonal slots.

The method thus comprises the phase of hot or cold forming depending on the material, of the band thus sheared according to an open profile, such as in the shape of a C, a U, an Ω of the like, terminating, at its profile ends, with free edges.

The method may further comprise folding the free edges of the open profile back onto themselves, according to different forms and procedures, to avoid cutting hazards for the installer or for different application purposes.

Referring first to FIGS. from 1 to 4, a first embodiment is shown, and a small variation, of a rigid section bar able to be articulated according the present invention.

The band 1 with longitudinal axis X—X has undergone in plane (FIG. 1) the shearing of polygonal slots in each of its weakening areas 9. Each weakening area 9 constitutes an articulation sections for the section bar 1', formed by the band 1 and shown in FIG. 2. As shown in FIGS. 2–4 sections bar 1 has a base 7 with two opposite sides 8, 8'.

The polygonal slots of each weakening area 9 comprise at least a pair of hexagons, one lengthened 10 and the other one shortened 11 with respect to its own transverse axis of symmetry Y—Y. The vertices 10', 11', 11" of the polygons 10 and 11 are not sharp, but chamfered with wide round or angular fillets. As shown in FIGS. 1–4, a hexagon 10 alternately extends into side 8 with hexagon 10 set entirely in side 8 above the extended portion 16 of hexagon 10 and then into side 8' with hexagon 11 entirely in side 8'. This permits section bar 1 to be articulated to either the right or left in the plane of base 7.

The lighteners are represented by slots 12, more or less lengthened, depending on the required linear weakening, arranged on transverse straight lines passing through transverse sides 8, 8' between the hexagons 10, 11 and also by punctiform lighteners 13 coaxial to the transverse axis of symmetry Y—Y in varying number and disposition, but on that axis Y—Y. In a successive length the polygons and in general the entire area of weakening 9 is upset with respect to the central axis. The section bar 1' obtained from the sheared band 1 may be provided with an outer base recess 14, with end chamfers. The section bar 1' presents free profile edges 15, 15 folded back onto themselves.

Figure 2:
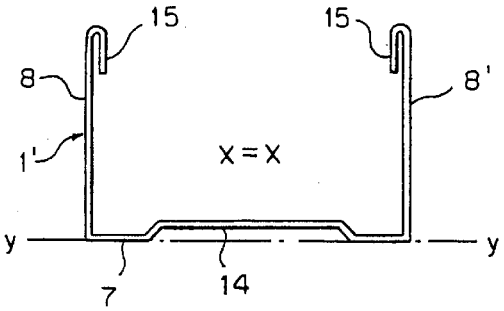
FIG. 2 shows a cross section of the section bar able to be articulated as per FIG. 1.
Figure 3:
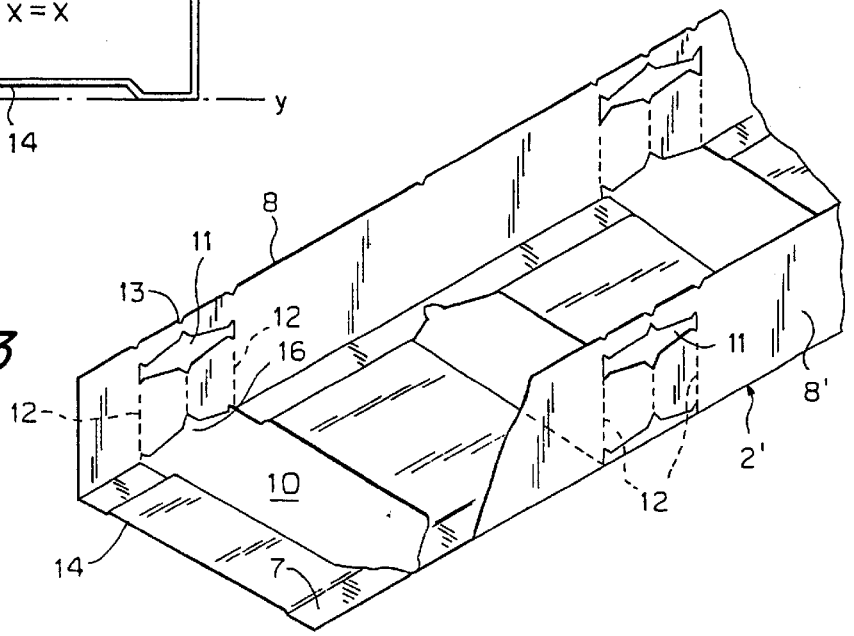
FIGS. 3 and 4 show in perspective view, respectively after fabrication forming and after manual deformation for installation, a length of a variation of the section bar able to be articulated shown in FIGS. 1 an 2.
Figure 4:
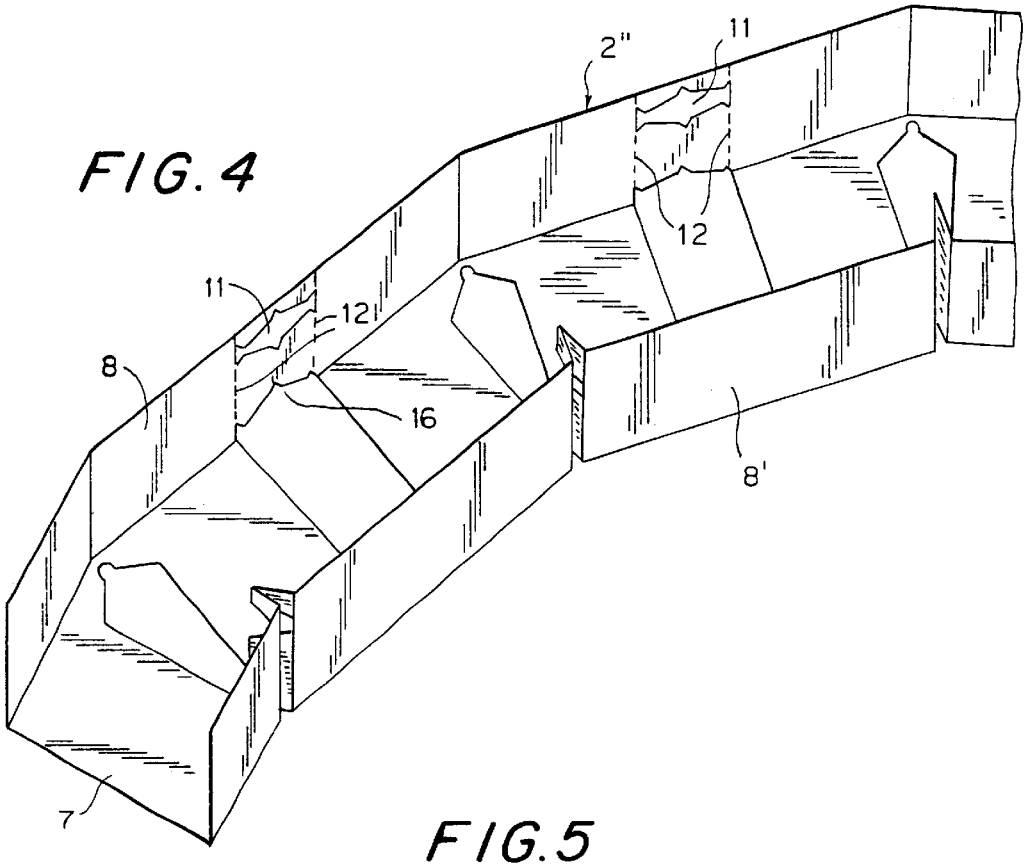
Figure 5:
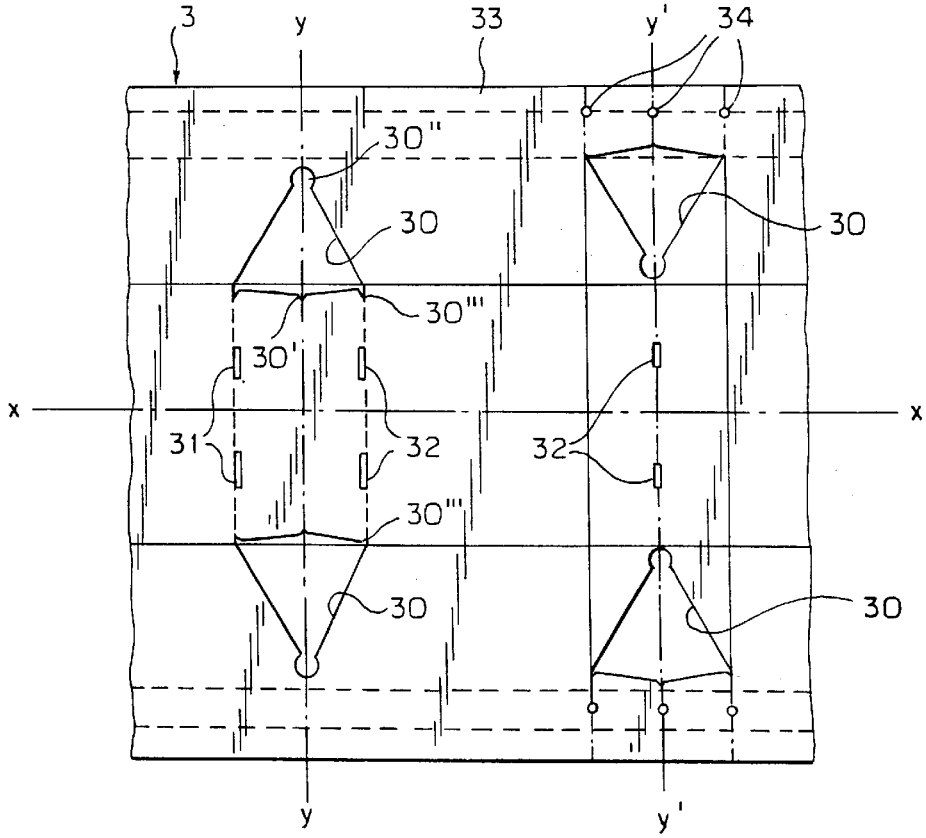
FIG. 5 shows in plan view a portion extending on a plane of a second embodiment of section bar able to be articulated according to the present invention.

In FIGS. 3 and 4 the section bar 2', 2" is a variation of the section bar in the FIGS. 1 and 2, lacking folded back free edges 15, 15. The same reference numbers are maintained as in FIGS. 1 and 2. In FIG. 4 the section bar 2" is shown in an example of deformation upon installation. As can be seen the deformation of the articulation sections maintains the coplanarity of the base or core of the section bar, i.e. the one provided with the possible recess 14.

For this type of deformation, the section bars 1' and 2' are suitable as a primary section bar for a wall.

With reference to FIGS. from 5 to 9, in a band 3 also having a base 7 and sides 8, the polygonal slots of each weakening area comprise at least a pair of quadrilaterals 30, in the shape of an arrowhead, specularly symmetrical with respect to the longitudinal band axis X—X.

The lighteners present are lengthened slots 31, 32 obtained on transverse straight lines in the segments joining the symmetrically opposite vertices 30'" of the quadrilaterals, and respectively in the segments joining the point vertices 30', 30" of the opposite quadrilaterals. The shape, the size and the number of slots 31, 32 are determined according to the thickness and to the type of section bar.

Figure 6:
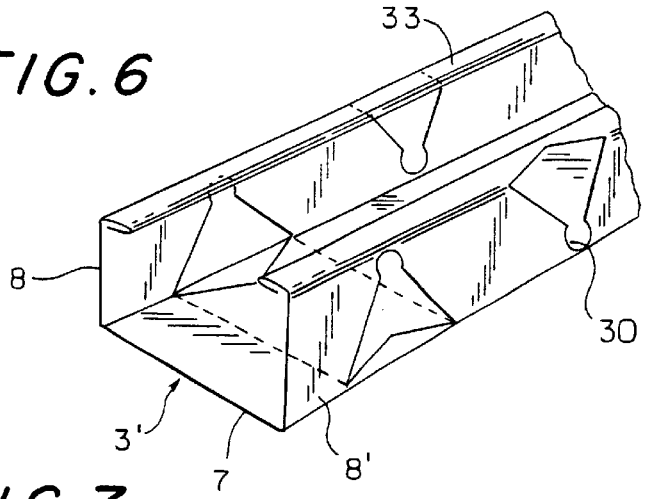
FIG. 6 shows in perspective view a portion of the section bar in FIG. 5.
Figure 7:
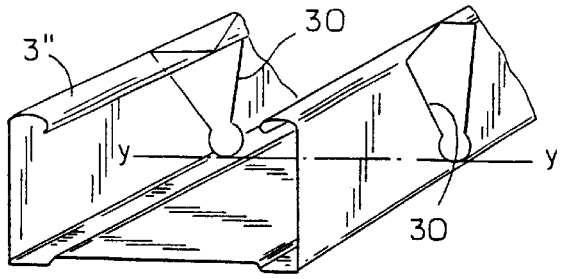
FIG. 7 shows in perspective view a portion of the section bar in FIG. 5.
Figure 8:
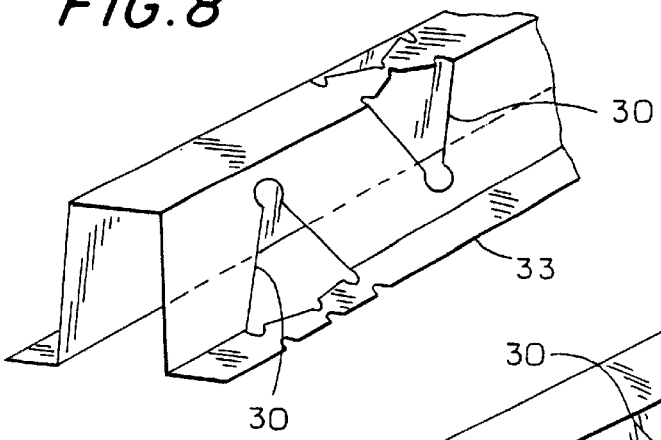
FIGS. 8 and 9 show in perspective view two portions of variations of the section bar in FIG. 5.
Figure 9:
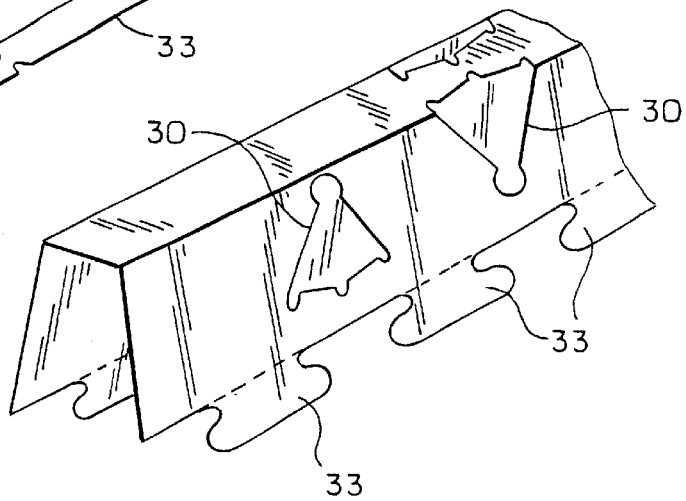

As shown in FIG. 6, from the sheared band 3 is obtained the section bar 3', whose free profile edges 33, with the punctiform lighteners 34, are folded back onto themselves and parallel to the base towards the interior of the section bar. The section bar 3' is therefore a secondary section bar for ceilings with depressed wings able to be deformed in vertical planes. As shown in FIG. 7, from a variation of the sheared band 3, lacking free edges 33, is obtained the section bar 3", whose ends are curved towards the base. The section bar 3" is therefore a secondary section bar for ceilings with rounded wings, able to be deformed in vertical planes around axis Y—Y shown in the figures. The FIGS. 8 and 9 show two different forms of Ω shaped and U shaped section bars, respectively with fastening wings folded outward parallel to the base and with wings machined to serve as supports. It is evident that other forms of execution of the section bars can be envisioned.

From the embodiments of the section bar described and shown it is evident that the section bar able to be articulated according to the invention is different from the solutions provided by the prior art. Specifically, the section bar according to the invention is substantially rigid, continuous, free of hinges occupying the inner space of the section bar after its fabrication, and therefore particularly valid for its use in collaboration with uprights and other constructive elements.

The invention thus conceived can be subject to numerous modifications and variations without thereby departing from the scope of the inventive concept. Moreover, all components may be replaced by technical equivalent elements.

In practice modifications and/or improvements are obviously possible, all within the scope of the claims that follow.

What is claimed is:

1. A rigid section bar usable as an architectural element to form walls and ceilings, comprising:

a band of plane material having an open profile with a base (7) and two sides;

the band having a first plurality of polygonal slots forming weaken areas that allow the section bar to be manually bent in a first direction and a second plurality of polygonal slots different from the first plurality of polygonal slots forming weaken areas that allow the section bar to be manually bent in a second direction opposite to that of the first direction;

the first plurality of polygonal slots and the second plurality of slots being reversibly and alternatively disposed at a preselected interval along a longitudinal axis of the band;

at least one of the first and second plurality of polygonal slots being substantially located in one of the two sides;

at least one of the first and second plurality of polygonal slots extending from the base to at least one of the two sides; and the band having lighteners on straight lines transverse to longitudinal axis of the band passing through vertices of said polygonal slots.

2. The section bar according to claim 1, wherein the two sides having free edges (15, 15) folded back onto themselves.

3. The section bar, according to claim 2, wherein said free edges are folded parallel to the base outward.

4. The section bar, according to claim 2, wherein said free edges are folded parallel to the base inward.

5. The section bar, according to claim 2, wherein said free edges are folded in an arch towards the base.

6. The section bar, according to claim 1, wherein said first and second plurality of polygonal slots comprise at least first and second hexagons, the first hexagon being longer than the second hexagon with respect to a transverse axis of symmetry (Y—Y), the second hexagon of the first plurality of polygonal slots being located in one of the two sides, the second hexagon of the second plurality of polygonal slots being located in another of the two sides, and the first hexagon of both the first arid second plurality of polygonal slots being located substantially in the base, wherein said lighteners are slots positioned on transverse straight lines passing on transverse sides of the hexagons between said hexagons and punctiform lighteners coaxial to said transverse axes of symmetry (Y—Y) of said hexagons;

wherein the section bar is manually bendable in opposite directions in the plane of the base.

7. The section bar, according to claim 1, wherein said first and second plurality of polygonal slots comprise at least a pair of quadrilaterals, in a shape of arrow heads, symmetrical to the longitudinal axis of the band (X—X), the pair of quadrilaterals being respectively located substantially in the two sides;

wherein an apex of the arrow heads comprising the first plurality of polygonal slots points toward the base and an apex of the arrow heads comprising the second plurality of polygonal slots points away from the base; and wherein the section bar is manually bendable vertically up or down from the longitudinal axis (X—X) around a line in the base perpendicular to the longitudinal axis (X—X) of the section bar.

8. The section bar, according to claim 1, wherein the base is provided with a recess upward with end chamfers.

* * * * *

UNITED STATES PATENT AND TRADEMARK OFFICE

CERTIFICATE OF CORRECTION

PATENT NO. : 6,434,908 B1
DATED : August 20, 2002
INVENTOR(S) : Massimo Ferrante It is certified that error appears in the above-identified patent and that said Letters Patent is hereby corrected as shown below:

Title page, Item [54], and Column 1, line 1,
delete "CAPS".

Signed and Sealed this

Twenty-eighth Day of January, 2003

JAMES E. ROGAN
*Director of the United States Patent and Trademark Office*